US010937340B2

(12) United States Patent
Smith

(10) Patent No.: US 10,937,340 B2
(45) Date of Patent: Mar. 2, 2021

(54) MAGNETIC CALENDAR CARRIER WITH PEEL OFF CALENDAR LABELS HAVING SCRATCH OFF DATES FOR PILL MINDING

(71) Applicant: Suncoast Marketing, Inc., Fort Lauderdale, FL (US)

(72) Inventor: Michael J. Smith, Boca Raton, FL (US)

(73) Assignee: SUNCOAST MARKETING, INC., Davie, FL (US)

( * ) Notice: Subject to any disclaimer, the term of this patent is extended or adjusted under 35 U.S.C. 154(b) by 0 days.

(21) Appl. No.: 16/829,854

(22) Filed: Mar. 25, 2020

(65) Prior Publication Data

US 2020/0312197 A1 Oct. 1, 2020

Related U.S. Application Data

(60) Provisional application No. 62/824,673, filed on Mar. 27, 2019.

(51) Int. Cl.

| | |
|---|---|
| ***G09F 3/02*** | (2006.01) |
| ***G09F 3/10*** | (2006.01) |
| ***B42D 5/04*** | (2006.01) |

(52) U.S. Cl.

CPC ..... *G09F 3/02* (2013.01); *B42D 5/04* (2013.01); *G09F 3/10* (2013.01); *G09F 2003/0208* (2013.01); *G09F 2003/0257* (2013.01); *G09F 2003/0273* (2013.01)

(58) Field of Classification Search

CPC ..... B42D 5/04

See application file for complete search history.

(56) References Cited

U.S. PATENT DOCUMENTS

| | | | | |
|---|---|---|---|---|
| 3,757,441 A * | 9/1973 | Baustin | A61J 7/04 | 40/638 |
| 4,580,360 A * | 4/1986 | Gribb | G09F 3/00 | 281/42 |
| 4,752,087 A * | 6/1988 | Weisbach | B42D 15/00 | 206/102 |
| 4,830,407 A * | 5/1989 | Sadler, Jr. | G09F 3/10 | 116/308 |
| 4,905,388 A * | 3/1990 | Sinkow | G09F 3/00 | 283/900 |
| 5,683,775 A * | 11/1997 | Franklin | G09F 3/10 | 206/411 |
| 5,881,597 A * | 3/1999 | Brooks | A47G 23/16 | 73/428 |
| 7,032,535 B2 * | 4/2006 | Halstead | G09F 3/10 | 116/308 |

(Continued)

*Primary Examiner* — Kyle R Grabowski

(74) *Attorney, Agent, or Firm* — The Concept Law Group, PA; Scott D. Smiley; Scott M. Garrett

(57) ABSTRACT

A promotional item is arranged as a calendar having a magnetic sheet that acts as a label carrier. On a front side of the magnetic sheet are a plurality of peel-off labels that can be affixed to items such as medicine containers. The magnetic sheet can have advertising printed on the front side as well. The labels can be stacked so that there are multiple labels for each time period (month, week), and the labels have portions of scratch-off material for marking the passage of time (e.g. days) to indicate the item was used for a given time period, such as indicating that the medication was taken on a given day.

12 Claims, 10 Drawing Sheets

(56) References Cited

U.S. PATENT DOCUMENTS

| | | | | |
|---|---|---|---|---|
| 7,387,208 | B2 * | 6/2008 | Londino | B42D 5/065<br>206/534 |
| 2005/0280257 | A1 * | 12/2005 | Nijjer | B42D 5/04<br>283/2 |

* cited by examiner

MAGNETIC CALENDAR CARRIER WITH PEEL OFF CALENDAR LABELS HAVING SCRATCH OFF DATES FOR PILL MINDING

CROSS REFERENCE

This application claims priority to provisional application No. 62/824,673, filed Mar. 27, 2019, and titled "Magnetic Calendar Carrier With Peel-Off Calendar Labels Having Scratch Off Dates for Pill Minding," the entirety of which is hereby incorporated by reference.

FIELD OF THE DISCLOSURE

The disclosure related generally to promotional materials and devices, and more particularly to a promotional calendar having peel off members that can be used as pill minders to track medication usage.

BACKGROUND OF THE DISCLOSURE

Promotional materials are used by businesses to market their products and services. Typically promotional materials are some useful or interesting article that has a business name on the article, and these articles are given out to people or other businesses that are in the target market of the business distributing the promotional materials. Common examples of promotional materials include calendars, beverage containers (e.g. mugs), coasters, shirts, writing pens, and many others. These articles are sold to businesses for use in promoting and marketing the business, and the entity that sells them typically takes orders that include the graphic element to be included on the articles, and then has the graphic element printed on a quantity of articles.

Calendars are commonly provided as either a printed sheet, or as a booklet format where each page shows a month and the pages can be turned to reveal a new month. A business logo is typically printed on the sheet or on each page, and the calendar can be set upright on a desk or hung on a wall. In some versions the calendar is printed on a magnetic sheet that can be affixed to a ferromagnetic surface, such as a refrigerator door. Although these calendar formats are useful, they require a certain amount of space. That is, they can't be placed on a small item that has some date relevance, like a medicine container.

Therefore there exists a need for the above identified problems.

SUMMARY OF THE INVENTIVE EMBODIMENTS

The invention provides a promotional calendar item that overcomes the hereinafore-mentioned disadvantages of the heretofore-known devices and methods of this general type and that allows a user to track daily usage of something, such as medication.

In accordance with some embodiments of the inventive disclosure, there is provided a prescription container labelling system that includes a magnetic sheet substrate having a low tack surface, and a plurality of labels disposed on the low tack surface of the magnetic sheet substrate. Each one of the plurality of labels includes an adhesive layer disposed on an adhesive side opposite the viewing side. Each label further including a plurality of non-contiguous regions covered by a respective one of a plurality of portions of a layer of scratch-off material. Each portion has an indicia corresponding to a unique one of a calendar date.

In accordance with another feature, the plurality of non-contiguous regions are arranged is five by seven matrix.

In accordance with another feature, the magnetic sheet substrate further comprises an opening configured to hang the magnetic sheet substrate on a wall-mounted hanger.

In accordance with another feature, the labels are arranged in a matrix on the sheet substrate.

In accordance with another feature, the plurality of labels are arranged in a plurality of stacks of labels, wherein labels in each stack represent a different time period.

In accordance with another feature, the each stack represents a different month.

In accordance with some embodiments of the inventive disclosure, there is provided a prescription container labelling system that includes a sheet substrate having a low tack surface, and a plurality of labels disposed on the low tack surface of the flat base substrate. Each one of the plurality of labels including an adhesive layer disposed on an adhesive side opposite the viewing side, each one of the plurality of labels having, on a viewing side of the label, and a plurality of non-contiguous regions covered by a respective one of a plurality of portions of a layer of scratch-off material, and wherein each portion has an indicia corresponding to a unique one of a calendar date.

In accordance with another feature, the plurality of non-contiguous regions are arranged is five by seven matrix.

In accordance with another feature, the sheet substrate is a formed as a roll.

In accordance with another feature, the labels are arranged in a matrix on the sheet substrate.

In accordance with some embodiments of the inventive disclosure, there is provide a promotional calendar item that includes a magnetic label carrier having a low tack surface on a front side, and an aperture through the magnetic label carrier proximate to a top edge. There is further included a plurality of labels disposed on the front side, wherein each one of the plurality of labels includes an adhesive side facing the front side of the magnetic label carrier, and a printed side. The printed side includes a plurality of scratch-off portions which each cover a graphic indicator on the printed side. There is further included a space on the front side for advertising indicia.

In accordance with another feature, the plurality of scratch off portions are arranged is five by seven matrix.

In accordance with another feature, the magnetic label carrier is configured in a rectangle.

In accordance with another feature, the plurality of labels are arranged in a matrix on the magnetic label carrier.

In accordance with another feature, the plurality of labels are arranged in a plurality of stacks of labels, wherein labels in each stack represent a different time period.

In accordance with another feature, the each stack represents a different month.

Although the invention is illustrated and described herein as embodied in a promotional calendar item, it is, nevertheless, not intended to be limited to the details shown because various modifications and structural changes may be made therein without departing from the spirit of the invention and within the scope and range of equivalents of the claims. Additionally, well-known elements of exemplary embodiments of the invention will not be described in detail or will be omitted so as not to obscure the relevant details of the invention.

Other features that are considered as characteristic for the invention are set forth in the appended claims. As required, detailed embodiments of the present invention are disclosed herein; however, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one of ordinary skill in the art to variously employ the present invention in virtually any appropriately detailed structure. Further, the terms and phrases used herein are not intended to be limiting; but rather, to provide an understandable description of the invention. While the specification concludes with claims defining the features of the invention that are regarded as novel, it is believed that the invention will be better understood from a consideration of the following description in conjunction with the drawing figures, in which like reference numerals are carried forward. The figures of the drawings are not drawn to scale.

Before the present invention is disclosed and described, it is to be understood that the terminology used herein is for the purpose of describing particular embodiments only and is not intended to be limiting. The terms "a" or "an," as used herein, are defined as one or more than one. The term "plurality," as used herein, is defined as two or more than two. The term "another," as used herein, is defined as at least a second or more. The terms "including" and/or "having," as used herein, are defined as comprising (i.e., open language). The term "coupled," as used herein, is defined as connected, although not necessarily directly, and not necessarily mechanically. The term "providing" is defined herein in its broadest sense, e.g., bringing/coming into physical existence, making available, and/or supplying to someone or something, in whole or in multiple parts at once or over a period of time.

"In the description of the embodiments of the present invention, unless otherwise specified, azimuth or positional relationships indicated by terms such as "up", "down", "left", "right", "inside", "outside", "front", "back", "head", "tail" and so on, are azimuth or positional relationships based on the drawings, which are only to facilitate description of the embodiments of the present invention and simplify the description, but not to indicate or imply that the devices or components must have a specific azimuth, or be constructed or operated in the specific azimuth, which thus cannot be understood as a limitation to the embodiments of the present invention. Furthermore, terms such as "first", "second", "third" and so on are only used for descriptive purposes, and cannot be construed as indicating or implying relative importance.

In the description of the embodiments of the present invention, it should be noted that, unless otherwise clearly defined and limited, terms such as "installed", "coupled", "connected" should be broadly interpreted, for example, it may be fixedly connected, or may be detachably connected, or integrally connected; it may be mechanically connected, or may be electrically connected; it may be directly connected, or may be indirectly connected via an intermediate medium. As used herein, the terms "about" or "approximately" apply to all numeric values, whether or not explicitly indicated. These terms generally refer to a range of numbers that one of skill in the art would consider equivalent to the recited values (i.e., having the same function or result). In many instances these terms may include numbers that are rounded to the nearest significant figure. Those skilled in the art can understand the specific meanings of the above-mentioned terms in the embodiments of the present invention according to the specific circumstances.

BRIEF DESCRIPTION OF THE DRAWINGS

The accompanying figures, where like reference numerals refer to identical or functionally similar elements throughout the separate views and which together with the detailed description below are incorporated in and form part of the specification, serve to further illustrate various embodiments and explain various principles and advantages all in accordance with the present invention.

DETAILED DESCRIPTION

Figure 1:
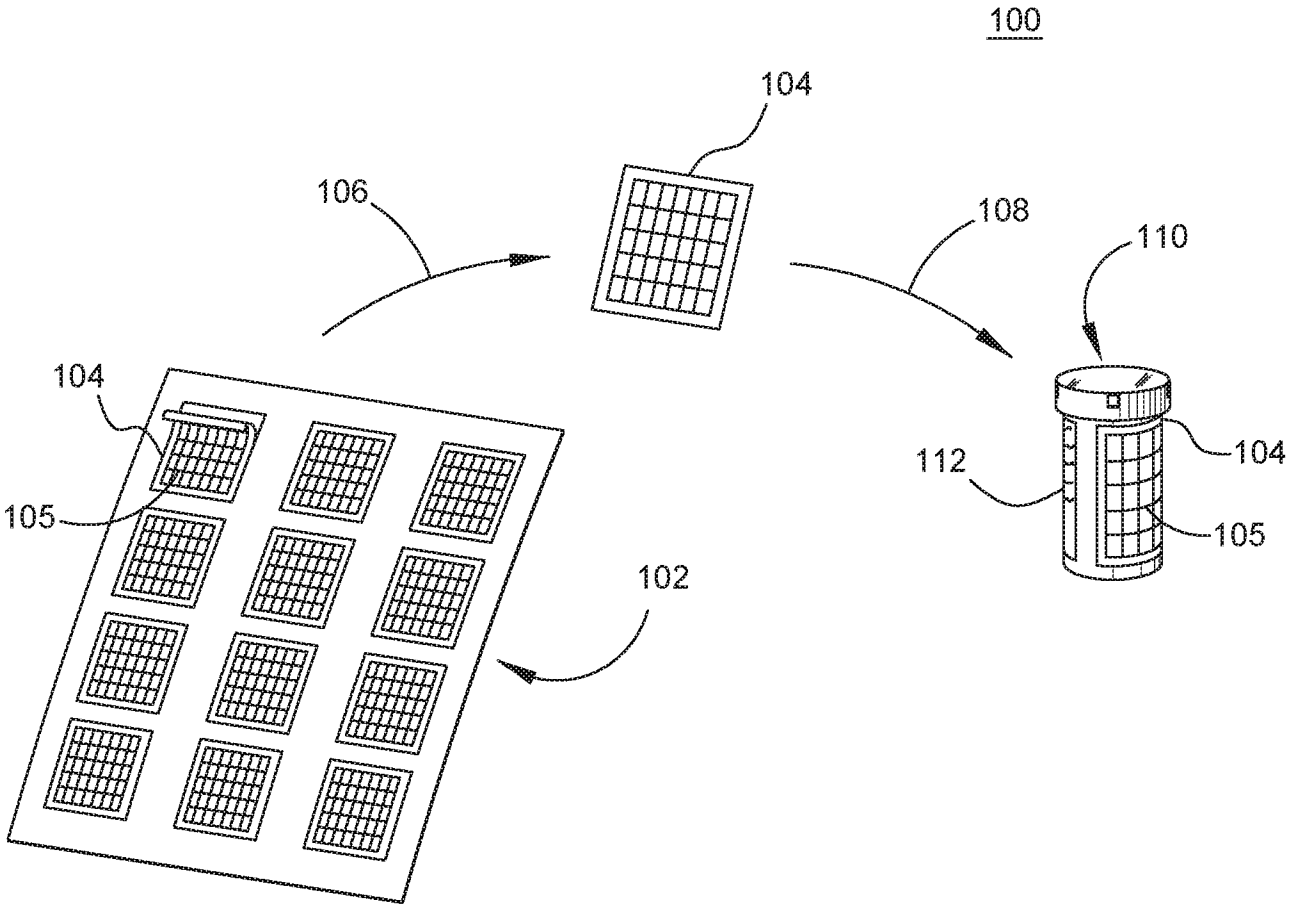
FIG. 1 is system diagram of a prescription container labelling system, in accordance with some embodiments.

While the specification concludes with claims defining the features of the invention that are regarded as novel, it is believed that the invention will be better understood from a consideration of the following description in conjunction with the drawing figures, in which like reference numerals are carried forward. It is to be understood that the disclosed embodiments are merely exemplary of the invention, which can be embodied in various forms.

FIG. 1 is system diagram of a prescription container labelling system 100, using a calendar in accordance with some embodiments. The system 100 allows a user (patient) to label their prescription medicine container(s) in a way to easily indicate and track whether the medicine has been taken for a given day or other dosing period. The system can be based on a promotional calendar article in which, for each month, there are multiple peel-off stickers that can be applied to another article like a medicine container. The system 100 alleviates the problems associated with medical organizing devices, such as pill organizer containers, which do not indicate what medicine is contained in them, by allowing the user to keep their medicine in the original prescription container, thereby avoiding the risk of mistakes associated with filling pill organizers.

The system 100 includes a label carrier 102 on which are disposed a plurality of labels such as label 104. The label carrier 102 can be a sheet substrate that has a low tack surface to prevent the labels 104 from adhering permanently to the carrier 102, and allowing easy removal of the labels 104 from the carrier 102. The carrier 102 can have indicia or other graphic elements, such as business logos or information, printed on it so that it can be used as a promotional article. The labels 104 have an adhesive disposed on the side of the label that is against the surface of the label carrier 102. The labels 104, in some embodiments, can be organized on the carrier 102 in a matrix of twelve positions, one for each month of the year. Each one of the labels at the different positions can correspond to a different month and can included printed indicia indicating the particular month on each label. In some embodiments, for each month, there can be multiple labels arranged in a stacked configuration so that there are multiple copies of labels for each month. The labels in each of the different positions are arranged on the carrier individually, separate and un-attached to any other one labels.

Each label 104 includes a plurality of regions 105 of a scratch-off material. Scratch-off material is commonly formed using monomer ink fluids that are cured using ultraviolet light to form polymeric, solid material that is opaque, but not hardened like a resin. The scratch-off regions 105 are disposed over indicia that is printed or otherwise formed on a viewing side of the label. There can also be indicia printed on the scratch-off material as well. For example, on labels configured to represent a monthly calendar, each of the regions of scratch-off material can have a number corresponding to a day of the month. These can be scratched off, for example, when the user takes their medication, to reveal some indicia indicating such, or at least differentiating it from the indicia printed in the scratch-off material.

The label 104 can be easily removed from the label carrier 102, as indicated by arrows 106, 108, and placed on a side of a prescription container 110. The prescription container 110 is the container in which the medication is provided from the pharmacy, or any other container used to store medication in bulk (i.e. other than as single doses). Of course, care should be taken not to cover the prescription label 112. Once the label 104 is placed on the prescription container, the user can then, upon taking the medication on a given day, remove the scratch-off portion corresponding to that day. In some embodiments, under each scratch-off region 105, there can be, printed on the label directly under the scratch-off region 105, another form of indicia. For example, the indicia under the scratch-off regions 105 can be a mark that contrasts in color with that of the scratch-off material (e.g. red or orange) in a way to clearly and easily indicate the scratch-off material has been removed and therefore the patient has taken the medication dosage for that day.

Figure 2:
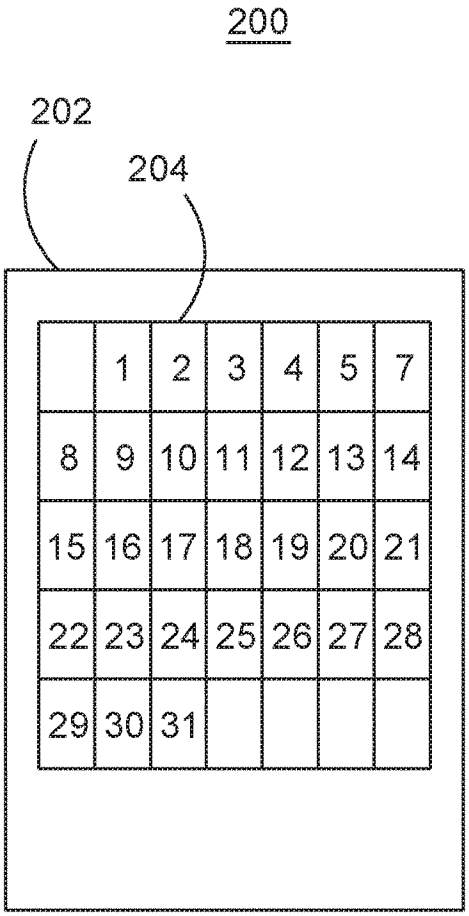
FIG. 2 is a plan view of a label having scratch-off portions for use in a prescription container labelling system, in accordance with some embodiments.

FIG. 2 is a plan view of a label 200 having scratch-off portions for use in a prescription container labelling system, in accordance with some embodiments. The label 200 includes a label body 202 that is generally a flat, sheet member. Here the front or viewing side is shown, with a matrix 204 of scratch off portions arranged in a seven columns by five rows arrangement, to have enough regions for every month. The scratch off portions can be non-contiguous, with some space between them, and with numerals corresponding to days of a month printed on the scratch-off portions with a different number on each portion. For each day, as the user takes their prescribed dosage, the corresponding scratch-off portion can be removed (i.e. scratched off). It will be appreciated by those familiar with the field that the example shown in FIG. 2 is not necessarily indicative of any specific scale, but the label 200 should be sized in order to allow it to fit on a portion of a common prescription container.

Figure 3:
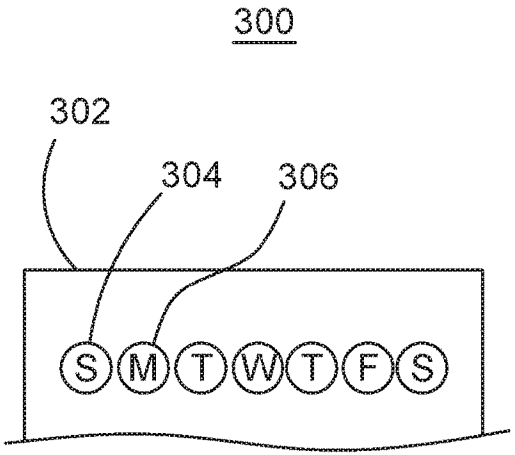
FIG. 3 is a plan view of a label having scratch-off portions for use in a prescription container labelling system, in accordance with some embodiments.

FIG. 3 is a plan view of a label 300 or label portion having scratch-off portions for use in a prescription container labelling system, in accordance with some embodiments. The label 300 includes a label body 302 on which the scratch-off portions, such as portions 304, 306, are disposed. The label 300 as shown here includes seven scratch off portions, each corresponding to a day of the week (e.g. Saturday, Monday, Tuesday, . . . , Sunday). Accordingly, a letter corresponding to the first or first and second letter(s) of the corresponding day are printed on each scratch-off region. In some embodiments, the series of seven regions can be duplicated on the label body. However, it is also contemplated that some users may have compromised eyesight, so it would be beneficial to maximize the size of the scratch off portions (e.g. 304, 306). Thus, the portion shown here (and in FIG. 4) may represent the entire label 300.

Figure 4:
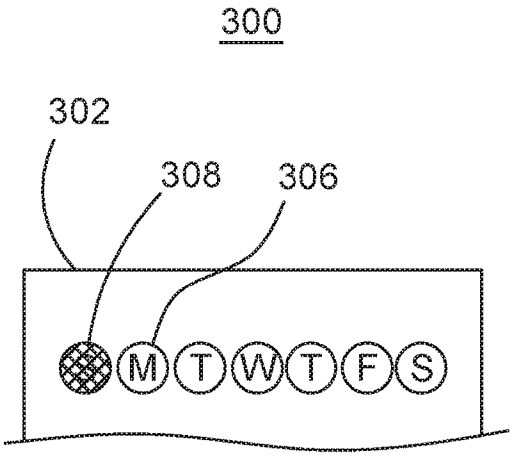
FIG. 4 is a plan view of a label having scratch-off portions for use in a prescription container labelling system with one of the scratch-off portions removed, in accordance with some embodiments

As an example, assume label 300 is placed on a prescription container, and that the present day is a Saturday. After the user takes the daily dosage of medication, then scratch-off portion 304 can be removed (i.e. scratched off), resulting in the label 300 being as shown in FIG. 4. Under the scratch-off portion for Saturday (304) printed on the label body is an indicia 308 that is visually distinct from the adjacent scratch-off portion 306. For example, indicia 308 can be a red or orange circle. Other forms of visually distinct indicia will occur to those skilled in the art and can be used equivalently.

Figure 5:
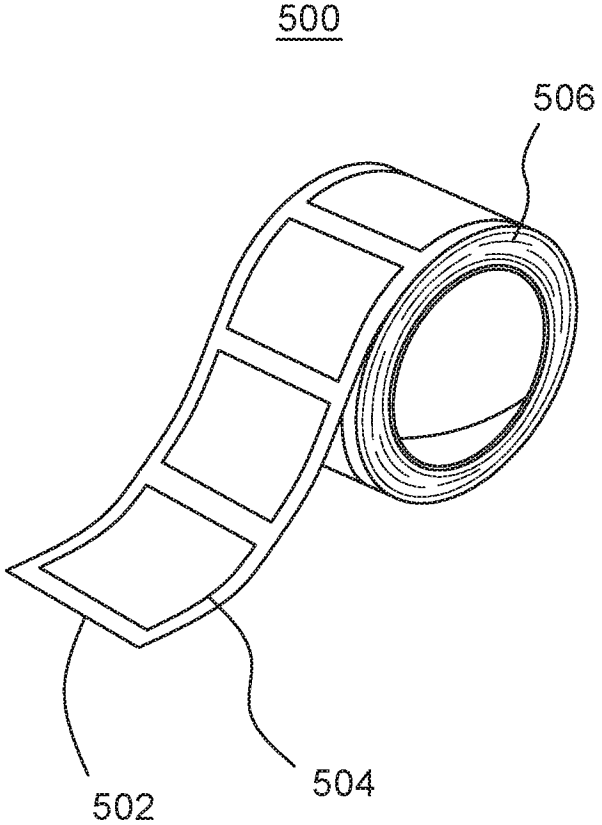
FIG. 5 is a perspective view of a roll of labels for use in a prescription container labelling system.

FIG. 5 is a perspective view of a roll 500 of labels for use in a prescription container labelling system. The roll 500 can be used as an alternative to the sheet arrangement of FIG. 1 when it is beneficial to have a large number of labels, such as in care facilities, or when a patient has a large number of medications. The roll 500 includes a ribbon-like label carrier 502 on which a plurality of labels such as label 504 are serially disposed, and the label carrier 502 can be wound into a roll or coil form 506. The labels (e.g. 504) each include a plurality of scratch off regions to allow the user to remove a scratch off portion for every day or applicable time period as occurred where the patient has taken the medication. The scratch-off regions can be provided in any suitable arrangement, include in a calendar format, and day of the week format, or a combination that includes scratch-off regions for different times of day for medications that are taken multiple times a day. Furthermore, each label 504 can have promotional indicia printed on it for a particular business or organization.

Figure 6:
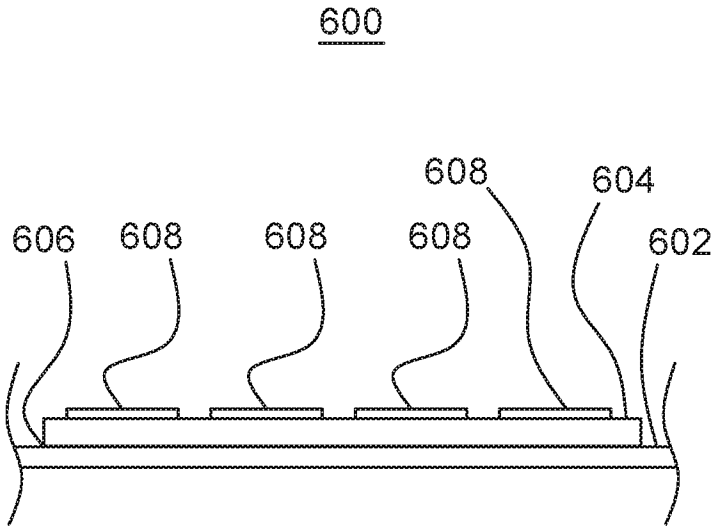
FIG. 6 is a side elevational view of a label, on a substrate, for use with a prescription container labelling system, in accordance with some embodiments.

FIG. 6 is a side elevational view of a label 600, on a substrate 602, for use with a prescription container labelling system, in accordance with some embodiments. The substrate 602 can be a sheet of material such as a coated paper that has a coated surface on which the labels are disposed which provides a low tack (adherence) for a layer of adhesive 606 disposed on the label body 604 opposite the viewing side 604 of the label 600. On the viewing side 604 there is a plurality of scratch-off regions 608. Each scratch-off region 608 can include an indicia corresponding to a dosing period of time (e.g. daily, or AM/PM for a given day, etc.). For example, each one of the plurality of regions 608 can have a unique (to the label 600) number or letter, corresponding to a date of a month or a day of a week. The coated surface of the substrate 602 is coated with a material that provides a low tack to the adhesive 606 so that, when the label body 604 is peeled off the substrate 600, it comes off with little resistance, and with all of the adhesive 606.

Figure 7:
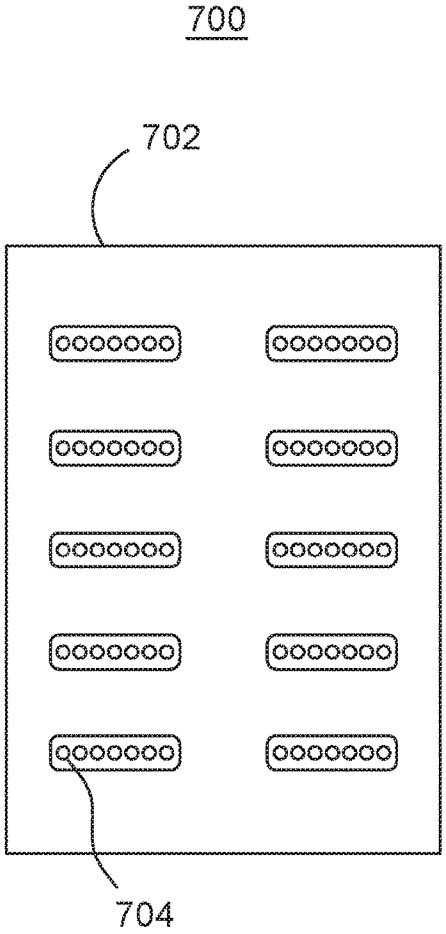
FIG. 7 is a plan view of a sheet of stacked labels with scratch-off portions, for use in a prescription container labelling system, in accordance with some embodiments.

FIG. 7 is a plan view of a sheet 700 of stacked labels with scratch-off portions, for use in a prescription container labelling system, in accordance with some embodiments. The sheet 700 includes a label carrier 702 as a substrate on which a plurality of labels are disposed in stacks. The each label stack 704 comprises two or more labels in a stacked relationship. Each label in the stack 704 comprises a plurality of scratch-off regions as in previously described labels, and can have contrasting or otherwise visually distinct indicia printed on the label body under the scratch-off portions.

Figure 8:
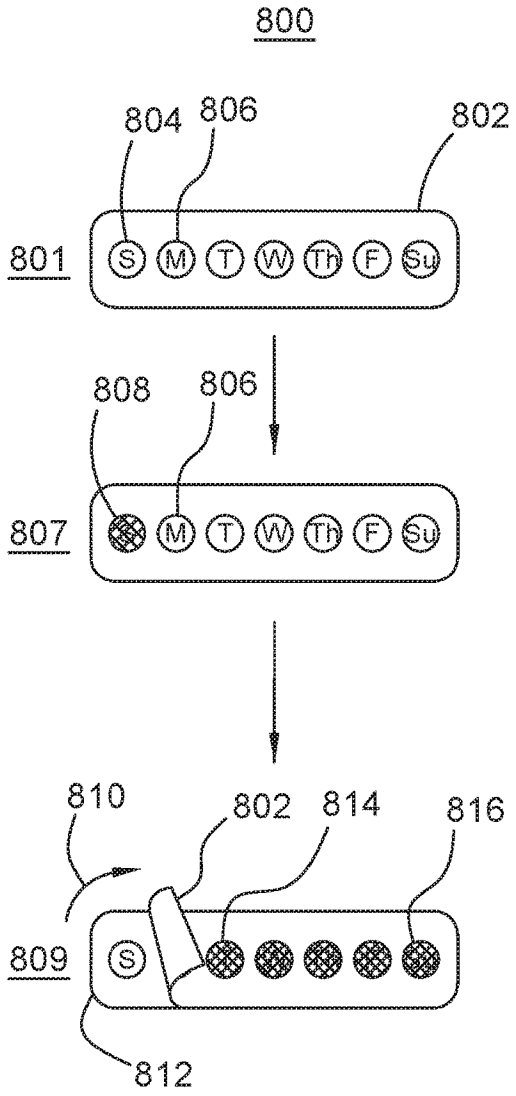
FIG. 8 is a progress diagram show how a stacked label is used, and then removed to reveal another label, in accordance with some embodiments.

FIG. 8 is a progress diagram show how a stacked label in a label stack 800 is used, and then removed to reveal another label, in accordance with some embodiments. The label stack 800 can be substantially similar to label stack 704 of FIG. 7. The label stack 800 includes a plurality of labels in a stacked relationship. Thus, in an initial state 801 of the label stack 800, a top label 802 is in view. The top label 802 is the upper-most label in the label stack 800. The top label 802 includes a plurality of regions of a scratch-off material, including regions 804, 806, which are shown being marked to correspond to days of the week. In a next state 807, the scratch-off material corresponding to scratch-off region 804 has been removed to reveal an indicia 808 on the viewing surface of the top label 802. The process can continue until, in state 809, all of the scratch-off regions on the top label 802 have been removed, leaving only the indicia portions such as 814, 816 (and 808) in view on the top label 802. The top label 802, as indicated by arrow 810, can then be peeled off the next lower label 812, which is a duplicate of the top label 802 in the initial state 801. By using a label stack, the size of the scratch off regions (e.g. 804, 806) relative to the space generally available on a prescription container can be maximized to facilitate usage and viewing of the labels for those users with diminished eyesight.

Figure 9:
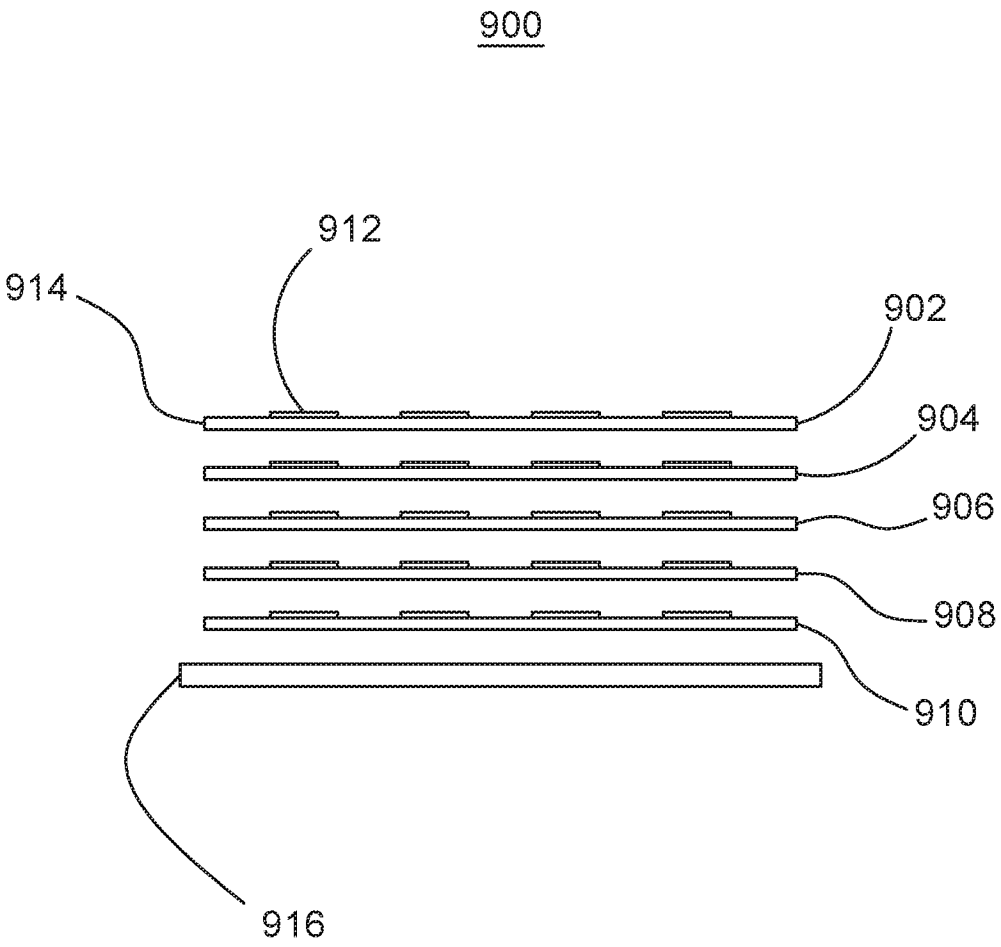
FIG. 9 is side elevational view of a stacked label arrangement for use in a prescription container labelling system, in accordance with some embodiments.

FIG. 9 is side elevational view of a stacked label arrangement for use in a prescription container labelling system, in accordance with some embodiments. The stacked label arrangement 900 include a label stack such as that discussed and shown in relation to FIGS. 7-8. The stacked label arrangement 900 includes a plurality of labels 902, 904, 906, 908, and 910 in a vertically stacked relationship, on top of a substrate 916. Each of the labels 902-910 includes a plurality of portions of scratch-off material such as portion 912. On a back side of each label 902-910, opposite its viewing side where the scratch-off portions are disposed, there is a layer of adhesive 914. The adhesive used in the adhesive layer 914 is a low tack adhesive that allows removal of each label 902-908 from the label below it, and the entire stack can be lifted off as a unit from the substrate 910. In some embodiments the adhesive layer on the upper labels 902-908 can be limited to a circumferential area so that there is no adhesive over the scratch off portions of labels 904-910.

Figure 10:
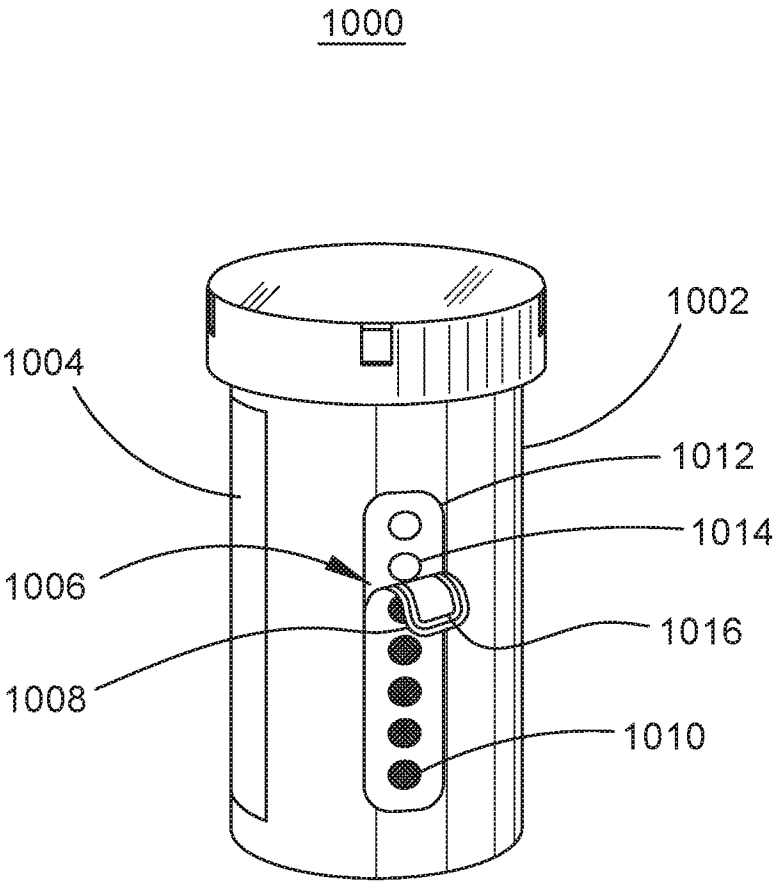
FIG. 10 is a side perspective view of a prescription container that includes a stack of labels that are configured to allow a user to keep track of whether the user has taken the medicine for the day.

FIG. 10 is a side perspective view of a prescription container 1000 that includes a stack of labels 1006 that are configured to allow a user to keep track of whether the user has taken the medicine for the day. The stack of labels 1006 is placed on an outside wall 1002 of the container 1000, on a region not already covered by, for example, a prescription label 1004. In the example of FIG. 10, the top label 1008 (or top-most label) shows only the indicia 1010 on the label that was disposed under a region of scratch off material that has since been removed by the user to indicate that a dose of medication was taken for the corresponding period of time. As such the top label 1008 is removed by peeling it off the stack (as indicated by showing it being curled back) to expose the next label 1012. The next label 1012 includes a plurality of scratch off portions such as portion 1014. The regions of scratch off material can have indicia printed on them (not shown here) to indicate a day of the week, for example. In order to avoid removing the scratch off material from lower labels, the adhesive layer 1016 can be disposed on the backside of each label to avoid the scratch off material. Here, the adhesive layer 1016 is shown around the edge or circumference of the back side of the label 1008.

Figure 11:
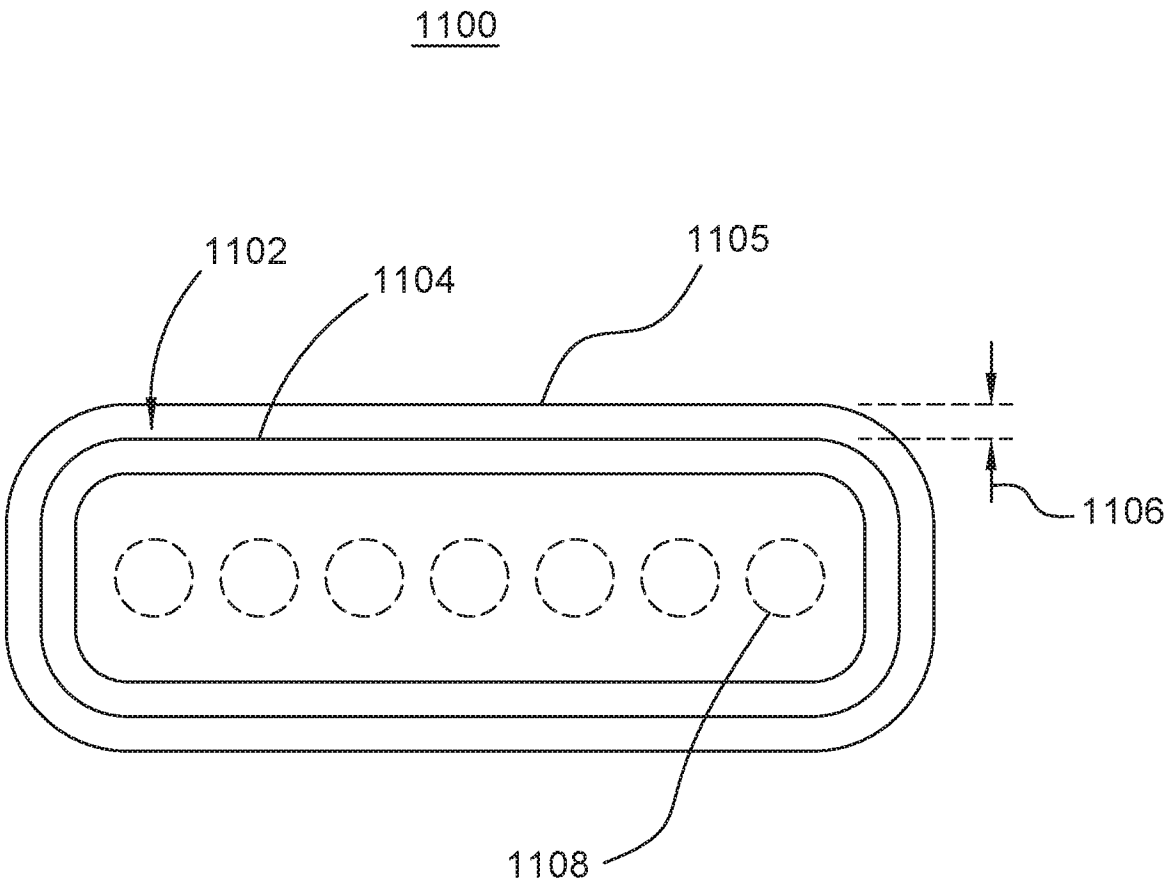
FIG. 11 shows the back side of a label configured for a label stack, in accordance with some embodiments.

FIG. 11 shows the back side 1102 of a label 1100 configured for a label stack, in accordance with some embodiments. The backside 1102 of the label 1100 faces the viewing side of the label below it in the label stack. A layer of adhesive 1104 is disposed about portions of the back side 1102 that are not directly over portions of scratch off material 1108 (indicated in dashed line here) on the label below label 1100. For example, as shown, the adhesive 1104 forms a box shape around a periphery of the back side 1102 (e.g. a circumference). In some embodiments, the adhesive 1104 can be spaced away from the edge 1105 by a distance 1106 in order to facilitate removal of the label 1100 from the label below it in the label stack.

Figure 12:
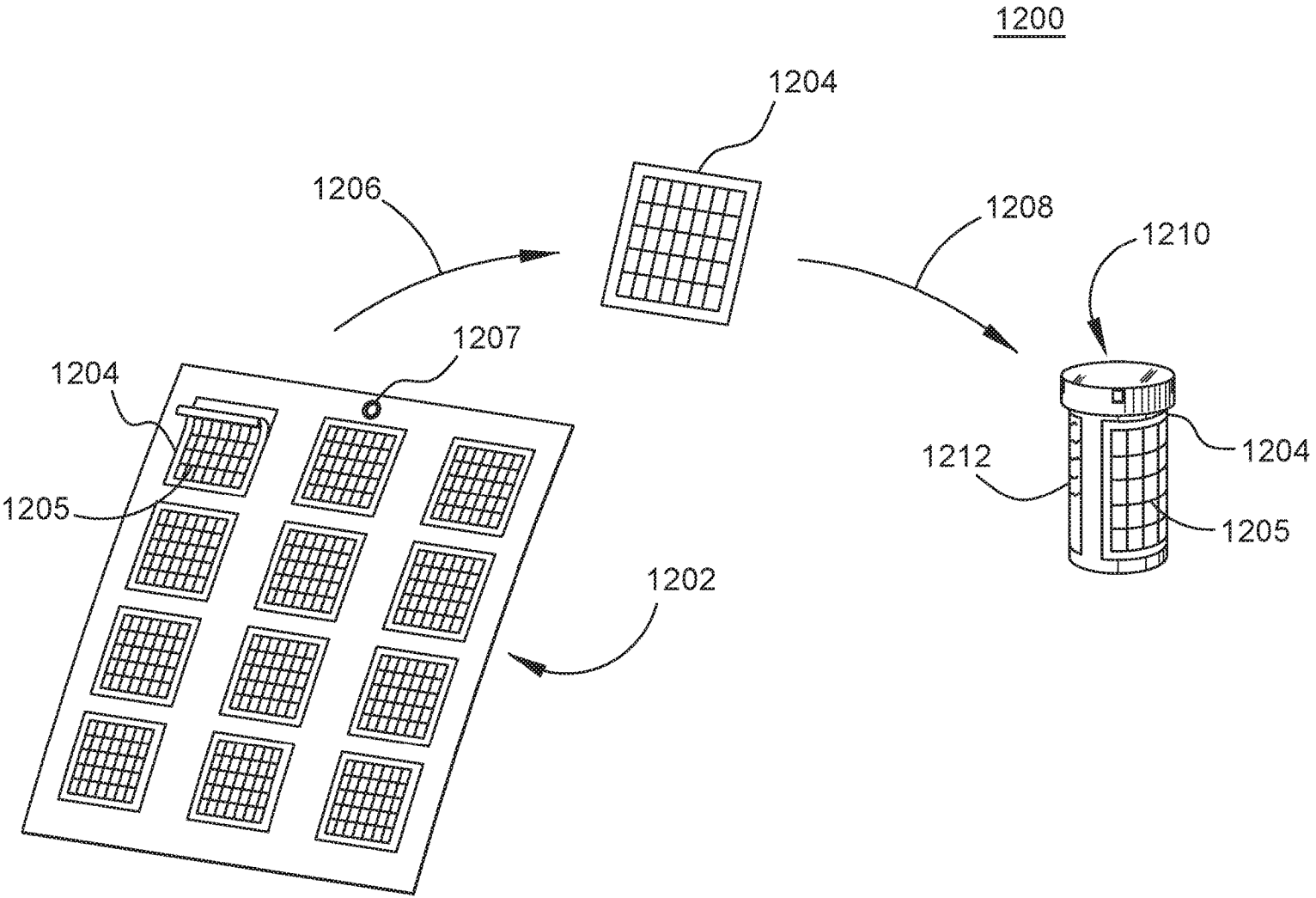
FIG. 12 is system diagram of a magnetic label carrier and associated use diagram, in accordance with some embodiments.

FIG. 12 is system diagram of a magnetic calendar carrier and associated use diagram, in accordance with some embodiments, for a promotional calendar article. The system 1200 allows a user to label their prescription medicine container(s) in a way to easily indicate and track whether the medicine has been taken for a given day or other dosing period. The system 1200 avoids the problems associated with medical organizing devices, such as pill containers, by allowing the user to keep their medicine in the original prescription container, thereby avoiding the risk of mistakes associated with filling such devices.

The system 1200 includes a magnetic label carrier 1202 on which are disposed a plurality of labels such as label 1204. The magnetic label carrier 1202 can be a magnetic sheet substrate that has a low tack surface to prevent the labels 1204 from adhering permanently to the magnetic label carrier 1202, and allowing easy removal of the labels 1204 from the magnetic label carrier 1202. The labels 1204 have an adhesive disposed on the back side of the label that is against the surface of the magnetic label carrier 1202. The labels 1204, in some embodiments, can be organized on the magnetic label carrier 1202 in a matrix of twelve labels, one for each month of the year. Each one of the labels can correspond to a different month and can included printed indicia indicating the particular month on each label 1204. The labels 1204 can therefore each represent a monthly calendar for a particular month, and be provided with a matrix of seven columns for the days of the week and rows corresponding to weeks of the month. The magnetic label carrier 1202 can include an aperture 1207 configured to allow non-magnetic mounting of the magnetic label carrier 1202 on a wall by hanging on a wall-mounted hook or similar structure.

Each label 1204 includes a plurality of regions 1205 of a scratch-off material Each region 1205 can correspond to one day of a calendar. Scratch-off material is commonly formed using monomer ink fluids that are cured using ultraviolet light to form polymeric, solid material that is opaque, but not hardened like a resin. The scratch-off regions 1205 are disposed over indicia that is printed or otherwise formed on a viewing side of the label. There can also be indicia printed on the scratch-off material. For example, on labels configured to represent a monthly calendar, each of the regions of scratch-off material can have a number corresponding to a day of the month.

A label 1204 can be easily removed from the magnetic label carrier 1202, as indicated by arrows 1206, 1208, and placed on a side of a prescription container 1210. The prescription container 1210 is the container in which the medication is provided from the pharmacy, or any other container used to store medication or other pills or similar consumable materials in bulk (i.e. other than as single doses). Of course, care should be taken not to cover the prescription label 1212 when present. Once the label 1204 is placed on the container 1210, the user can then, upon taking the medication on a given day, remove the scratch-off portion 1205 corresponding to that day. In some embodiments, under each scratch-off region 1205, there can be, printed on the label directly under the scratch-off region 1205, another form of indicia. For example, the indicia under the scratch-off regions 1205 can be a mark that contrasts in color with that of the scratch-off material (e.g. red or orange) in a way to clearly and easily indicate the scratch-off material 1205 has been removed and therefore the patient has taken the medication dosage for that day. The magnetic label carrier 1202 can have an aperture 1207 that allows the magnetic label carrier 1202 to be hung on a non-ferromagnetic surface.

Figure 13:
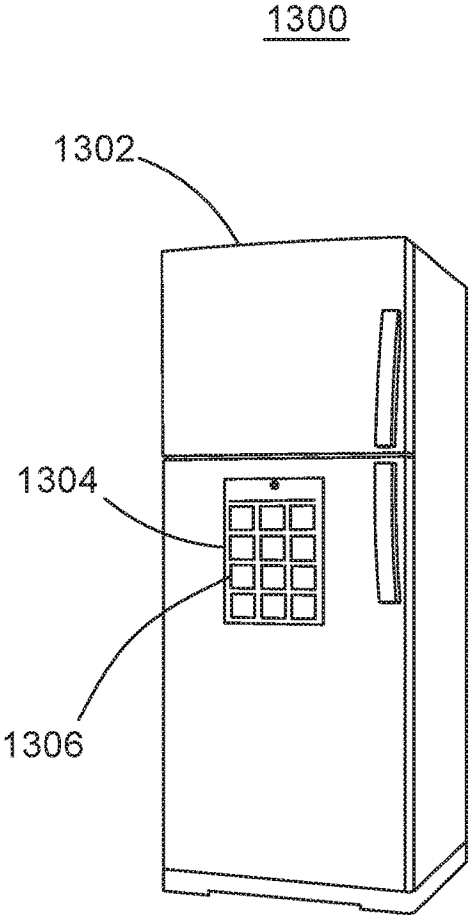
FIG. 13 is a usage diagram showing a magnetic label carrier magnetically affixed to a refrigerator, in accordance with some embodiments.

FIG. 13 is a usage diagram showing a magnetic label carrier 1304 magnetically affixed to a refrigerator 1302, in accordance with some embodiments. The refrigerator 1302 is a common household appliance with a door made out of steel or similar ferromagnetic material to which the magnetic label carrier 1304 will be attracted and affix itself through the magnetic attraction to the door material. Of course, the magnetic label carrier 1304 can be placed similarly on any ferromagnetic surface. While mounted on the refrigerator 202 or similar surface, the user can scratch off portions of the calendars (e.g. 1306) to indicate a pill has been taken for that day. That is, the labels on the magnetic label carrier 1304 can be left on the magnetic label carrier 1302 and used there, or peeled off the magnetic label carrier 1304 and affixed to a pill container and used there as in FIG. 12.

Figure 14:
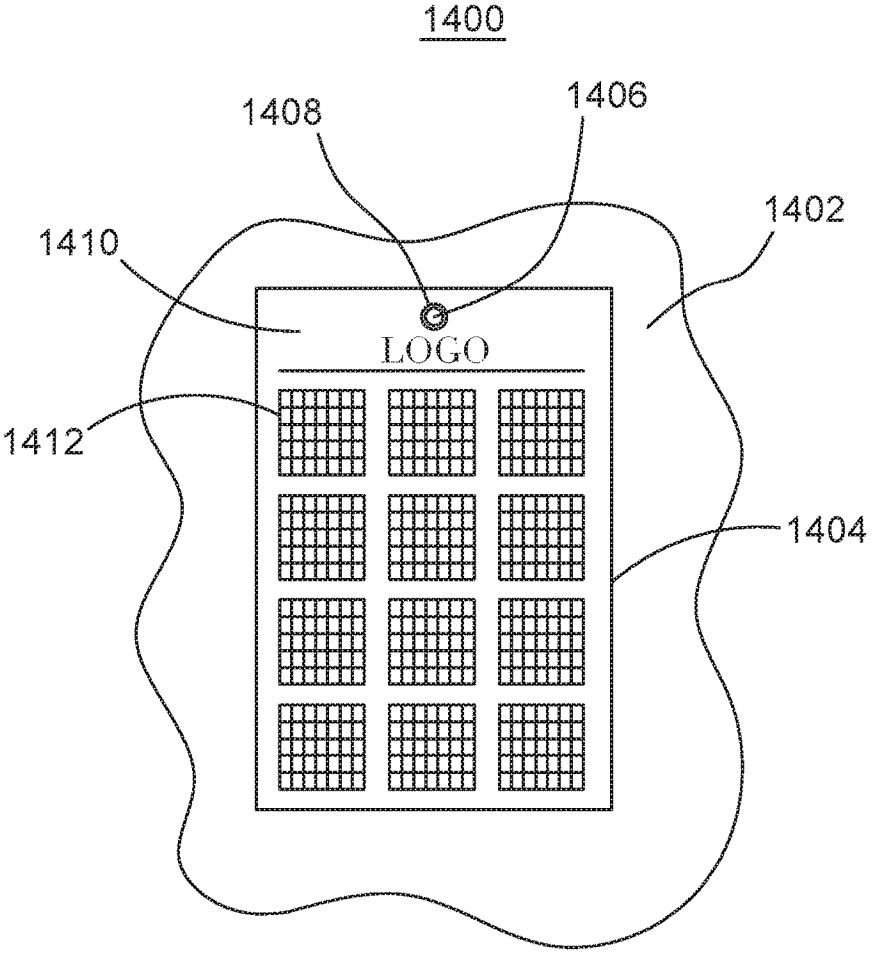
FIG. 14 is a usage diagram showing a magnetic label carrier being hung on a wall, in accordance with some embodiments.

FIG. 14 is a usage diagram showing a magnetic label carrier 1404 being hung on a wall 1402, in accordance with some embodiments. The wall 1402 is a non-ferromagnetic surface, and so there is no magnetic attraction between the magnetic label carrier 1404 and the wall 1402. However, the magnetic label carrier 1404 can include an opening 1406 through which a wall-mounted hanger 1408 (e.g. hook, nail, etc.) can be used to hang the magnetic label carrier 1404 on the wall 1402. It is further noted that the magnetic label carrier 1404 can include a space 1410 in which printing or other graphic artwork such as advertising or other information can be placed. Once hung then labels 1412 having scratch off calendars as previously described, and be used while on the magnetic label carrier 1404 or peeled off and placed on a container for use on the container.

Figure 15:
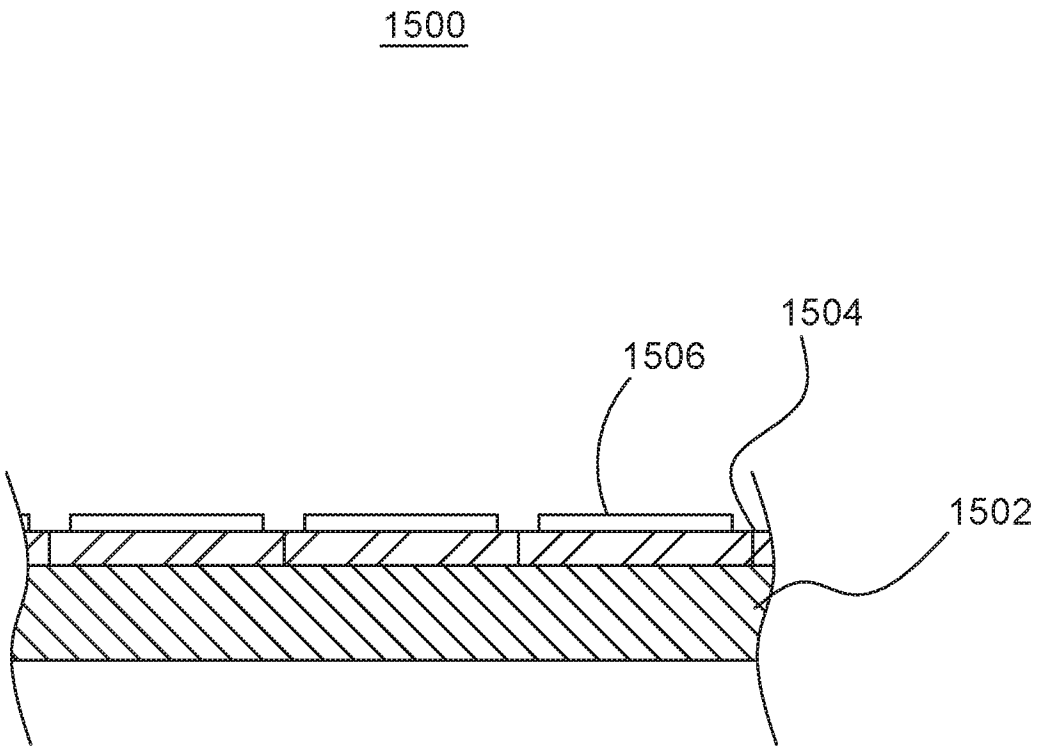
FIG. 15 is a cross section cutaway view of a magnetic label carrier, in accordance with some embodiments.

FIG. 15 is a cross section cutaway view of a magnetic label carrier 1500, in accordance with some embodiments. The magnetic label carrier 1500 includes a magnetic substrate 1502 that can be flexible and formed by any known process, including printing and curing or magnetic materials. On top of the magnetic substrate 1502 is a label layer 1504 that include material on which information is permanently printed, such as calendar numbering, month names, day names, etc. On top of certain portions of the label layer is a layer of scratch off material 1506 that is designed to be removed by mechanical disturbance (e.g. scratching) to reveal printed indicia below the scratch off material 1506 on the label layer 1504.

The inventive embodiments of the disclosure provide a promotional item that include date tracking labels for use in various applications. The structure of the promotional item allows it to be used as a calendar, as well as a carrier for labels that can be peeled off of the item and affixed to, for example, medicine containers. The labels include a scratch-off material that allows users to track daily usage of the article to which they are affixed. The calendar can be placed and held on both ferromagnetic and non-ferromagnetic surfaces by the carrier, which is made of a magnetic material and includes an aperture for hanging on walls. In some embodiments there are multiple labels stacked on top of each other so that, for example, when a user has multiple items for which periodic usage tracking is required, each item can have its own label.

What is claimed is:

1. A prescription container labelling system, comprising:

a magnetic sheet substrate having a low tack surface;

a plurality of labels disposed on the low tack surface of the magnetic sheet substrate, each one of the plurality of labels having a viewing side, each one of the plurality of labels being disposed on the low tack surface in a discrete location on the low tack surface of the magnetic sheet substrate so as to be spaced apart from and unattached to any other one of the plurality of labels, each one of the plurality of labels comprising:

an adhesive layer disposed on an adhesive side opposite the viewing side; and a plurality of non-contiguous regions covered by a respective one of a plurality of portions of a layer of scratch-off material, and wherein each portion has an indicia corresponding to a unique one of a calendar date; and additional labels stacked on top of each of the plurality of labels to form a plurality of stacks of labels, wherein each one of the additional labels in each one of the plurality of stacks of labels is removably adhered to a label below it and comprises a plurality of non-contiguous regions covered by a respective one of a plurality of portions of a layer of scratch-off material, and wherein each portion of the plurality of portions has an indicia corresponding to a unique one of a calendar date, wherein labels in each stack represent a different month.

2. The prescription container labelling system of claim 1, wherein the plurality of non-contiguous regions are arranged is five by seven matrix.

3. The prescription container labelling system of claim 1, wherein the magnetic sheet substrate further comprises an opening configured to hang the magnetic sheet substrate on a wall-mounted hanger.

4. The prescription container labelling system of claim 1, wherein the labels are arranged in a matrix on the magnetic sheet substrate.

5. A prescription container labelling system, comprising:

a sheet substrate having a low tack surface;

a plurality of labels disposed on the low tack surface of the sheet substrate, wherein each one the plurality of labels are arranged on the sheet substrate individually, separate and un-attached to any other one of the plurality of labels, each one of the plurality of labels comprising:

an adhesive layer disposed on an adhesive side opposite the viewing side;

each one of the plurality of labels having, on the viewing side of the label, a plurality of non-contiguous regions covered by a respective one of a plurality of portions of a layer of scratch-off material, and wherein each portion has an indicia corresponding to a unique one of a calendar date; and additional labels stacked on top of each of the plurality of labels to form a plurality of stacks of labels, wherein each one of the additional labels in each one of the plurality of stacks of labels is removably adhered to a label below it and comprises a plurality of non-contiguous regions covered by a respective one of a plurality of portions of a layer of scratch-off material, and wherein each portion of the plurality of portions has an indicia corresponding to a unique one of a calendar date, wherein labels in each stack represent a different month.

6. The prescription container labelling system of claim 5, wherein the plurality of non-contiguous regions are arranged is five by seven matrix.

7. The prescription container labelling system of claim 5, wherein the sheet substrate is a formed as a roll.

8. The prescription container labelling system of claim 5, wherein the labels are arranged in a matrix on the sheet substrate.

9. A promotional calendar item, comprising:

a magnetic label carrier having a low tack surface on a front side, an aperture through the magnetic label carrier proximate to a top edge;

a plurality of labels disposed on the front side and arranged in separate discrete locations spaced apart from each other on the front side such that the plurality of labels are each separate and unattached to any other one of the plurality of labels, wherein each one of the plurality of labels includes an adhesive side facing the front side of the magnetic label carrier, and a printed side, the printed side including a plurality of scratch-off portions which each cover a graphic indicator on the printed side;

additional labels stacked on top of each of the plurality of labels to form a plurality of stacks of labels, wherein each one of the additional labels in each one of the plurality of stacks of labels is removably adhered to a label below it and comprises a plurality of non-contiguous regions covered by a respective one of a plurality of portions of a layer of scratch-off material, and wherein each portion of the plurality of portions has an indicia corresponding to a unique one of a calendar date, wherein labels in each stack represent a different month a space on the front side for advertising indicia.

10. The promotional calendar item of claim 9, wherein the plurality of scratch off portions are arranged is five by seven matrix.

11. The promotional calendar item of claim 9, wherein the magnetic label carrier is configured in a rectangle.

12. The promotional calendar item of claim 9, wherein the plurality of labels are arranged in a matrix on the magnetic label carrier.

* * * * *